United States Patent [19]

Brogli et al.

[11] 4,002,326

[45] Jan. 11, 1977

[54] HOMOGENIZATION STIRRER

[76] Inventors: Hans G. Brogli, 42 Gotthelfstrasse, Basel; Werner F. Brogli, 3 Kindergartenstrasse, Reinach, both of Switzerland

[22] Filed: Mar. 7, 1975

[21] Appl. No.: 556,327

[30] Foreign Application Priority Data

Mar. 11, 1974 Switzerland ..... 3353/74

[52] U.S. Cl. ..... 259/95; 415/148

[51] Int. Cl.[2] ..... B01F 5/06; B01F 5/16

[58] Field of Search ..... 259/95, 96, 97, 7, 8; 415/149 A, 148, 131

[56] References Cited

UNITED STATES PATENTS

| | | | |
|---|---|---|---|
| 3,154,296 | 10/1964 | Balassa | 259/95 |
| 3,410,535 | 11/1968 | Balassa | 259/95 |
| 3,499,633 | 3/1970 | Bowen | 259/95 |

*Primary Examiner*—Robert W. Jenkins

[57] ABSTRACT

A homogenization stirrer is disclosed comprising a rotor and a stator between which a rubbing gap is provided. The stator includes passages through which the homogenized medium is thrust out by the action of the running rotor. The stator comprises two interengaging parts defining gaps between them which form said passages, one of these stator parts being axially adjustable in relation to the other for adjusting the width of the passage gaps and thus the flow rate of the medium, or its dwell time in the stirrer.

2 Claims, 7 Drawing Figures

HOMOGENIZATION STIRRER

BACKGROUND OF THE INVENTION

The present invention relates to a homogenization stirrer with a rotor and a stator between which there is a rubbing gap, the rotor being rotatable in relation to the stator for sucking a medium axially from one side, homogenizing it in the rubbing gap, and thrusting it out axially towards the opposite side through passages provided in the stator.

Homogenization stirrers of this kind are already known and are used, for example, in the production of emulsions. It may be desirable in such stirrers to adjust the intensity of the processing depending upon the composition of the medium. It would also be advantageous in some instances to adapt the stirrer to the viscosity of the medium, which may vary in the course of the homogenization. It has already been proposed, for this purpose, to axially displace the rotor and the stator of a homogenization stirrer in relation to one another for varying the width of the rubbing gap. It has been found, however, that by varying the width of the rubbing gap alone it is possible to adjust the intensity of the processing or to adapt the stirrer to the viscosity only in a very limited range. If the width of the rubbing gap is made too narrow then an excessive heating of the medium in the rubbing gap will be experienced which may damage certain substances in the medium.

It is therefore an object of this invention to provide a homogenization stirrer which will be adaptable in a wide range, and without danger of thermal damaging of the materials, to the desired intensity for the treatment and to the viscosity of the medium, even enabling it to be adapted during actual operation to the changes taking place in the viscosity and homogeneity of the medium in the course of the processing.

SUMMARY OF THE INVENTION

As a solution to this problem the homogenization stirrer according to this invention is characterized in that the stator comprises two interengaging parts defining gaps between them which form the stator passages, one of said two parts being axially adjustable in relation to the other part for adjusting the width of the stator passage gaps.

By making the width of the stator passage gaps narrower an increased resistance or back pressure can be opposed to the medium supplied by the rotor so that the flow rate is reduced and the dwell time of the medium in the rubbing gap is extended, whereby the treatment is intensified without causing excessive heating by friction in an unduly restricted rubbing gap.

BRIEF DESCRIPTION OF THE DRAWINGS

Various embodiments of the homogenization stirrer according to the invention are explained below in greater detail with reference to the drawings. In these drawings.

DETAILED DESCRIPTION OF PREFERRED EMBODIMENTS

Figure 1:
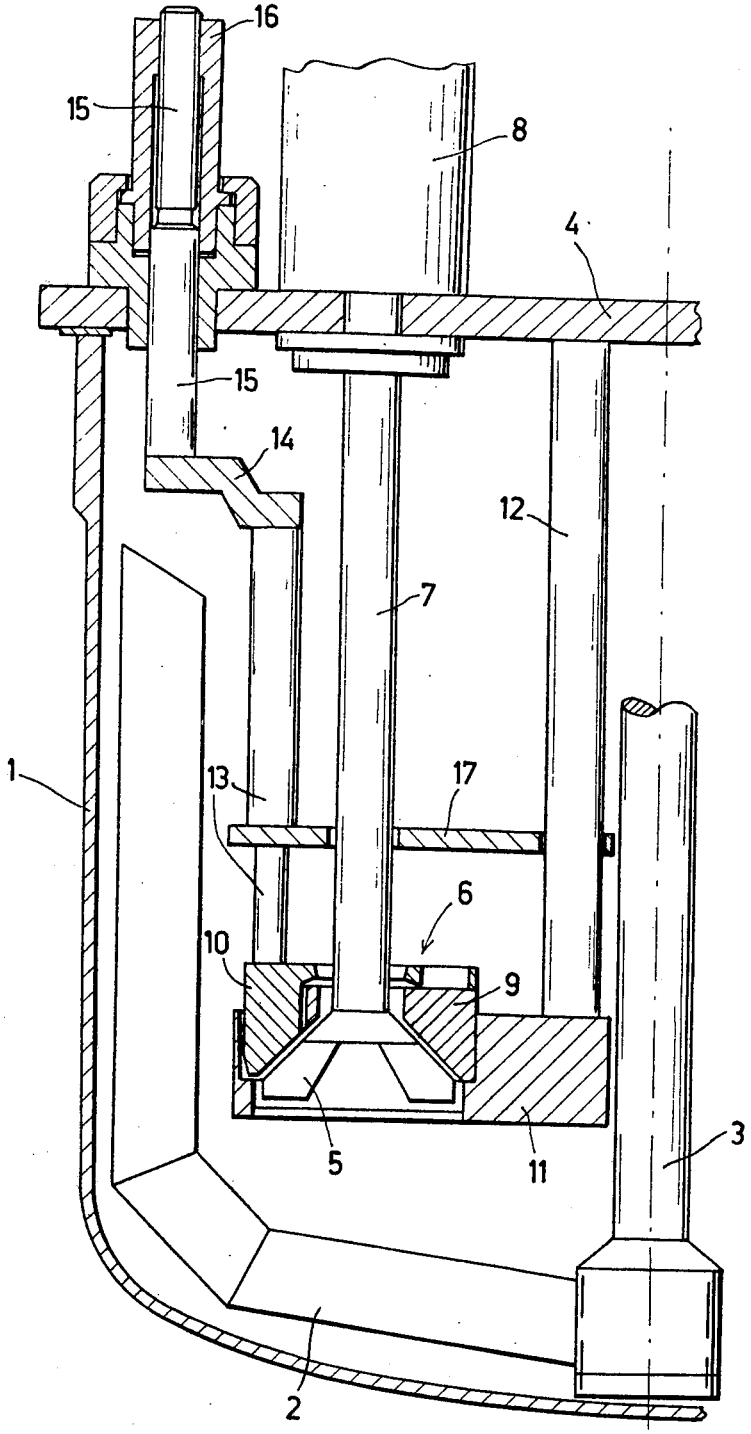
FIG. 1 is a vertical sectional view of a homogenization stirrer in a mixing vessel which also contains an anchor agitator.

FIG. 1 shows a combined mixing and homogenization apparatus with a vessel 1 in the center of which is mounted an anchor agitator 2 with a vertical shaft 3. The shaft 3 is mounted in a cover 4 of the vessel 1 and can be driven in the usual manner by its upper end (this not being shown in the drawing).

A homogenization stirrer with a rotor 5 and a stator 6 is mounted eccentrically in the vessel 1. The rotor shaft 7 is likewise mounted in the cover 4 and can be driven by means of a driving device 8. The medium to be mixed which is contained in vessel 1, is sucked by the running rotor 5 axially from below. The substance is homogenized in the rubbing gap formed between rotor 5 and stator 6, and is then thrust out upwardly through passages provided in the stator. The running rotor thus causes circulation of the substance in vessel 1.

Figure 2:
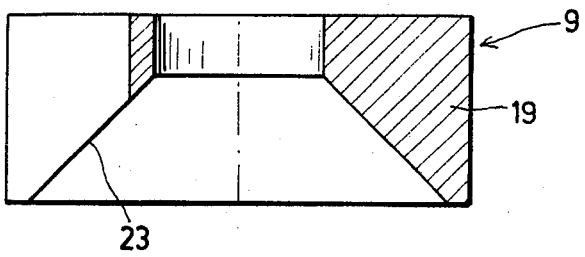
FIG. 2 is an enlarged sectional view of one stator part of the homogenization stirrer, taken along line A—A of FIG. 3.
Figure 3:
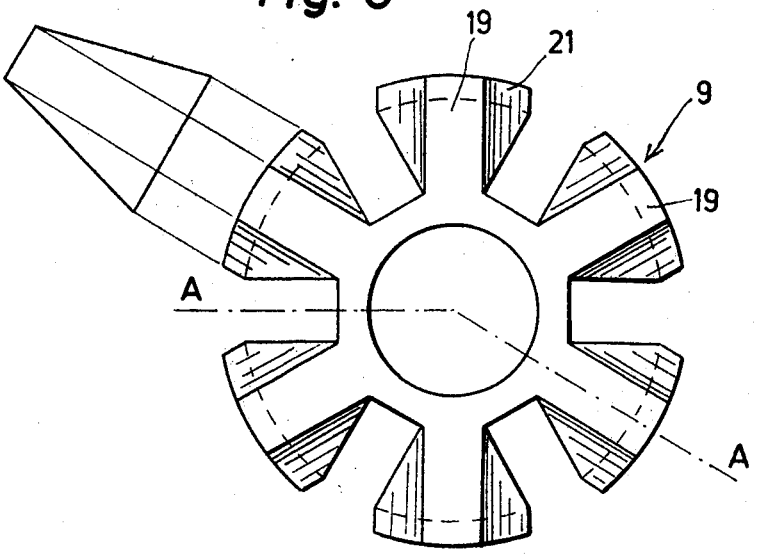
FIG. 3 is a plan view corresponding to FIG. 2.
Figure 4:
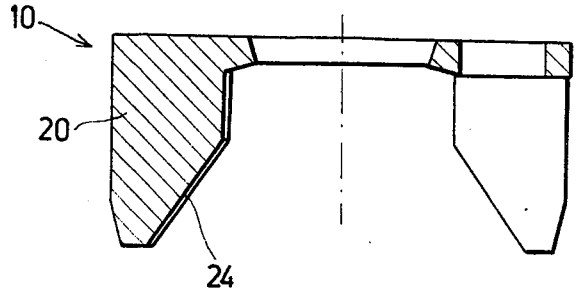
FIG. 4 is a sectional view of the other, axially adjustable stator part, taken along line B—B of FIG. 5.
Figure 5:
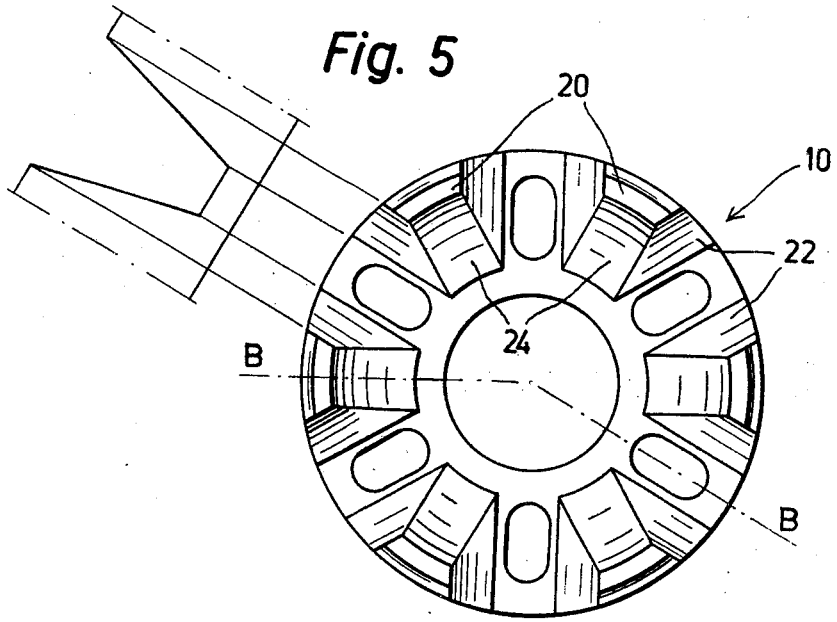
FIG. 5 is a view from below corresponding to FIG. 4.

The stator 6 is made up of two parts 9 and 10 which engage each other and one of which is shown more distinctly in FIGS. 2 and 3 and the other in FIGS. 4 and 5. The stator main part 9 is mounted in a fixed position; it is borne by a support 11 in its turn held by a bar 12 affixed to the cover 4.

The stator insert part 10 is adjustable in the axial direction. It is borne by a bar 13 affixed to a threaded bolt 15 by means of a connecting piece 14. The threaded bolt 15 is movable in an axial direction in the cover 4 and interacts with an adjusting nut 16 mounted rotatably, but not displaceably in the axial direction, on the cover 4. By rotating the adjusting nut 16 the stator insert part 10 can be adjusted axially, i.e. raised or lowered, in relation to the fixed stator main part 9 and thus also in relation to the rotor 5. A plate 17 affixed to the bar 13 enables the stator part 10 to be accurately guided and centered in relation to the stator part 9. The plate 17 is guided on the bar 12 by a bore.

The fixed and axially movable stator parts 9 and 10 respectively are each provided with six segments 19 and 20 respectively, the segments 20 of the stator insert part 10 fitting into the spaces between the segments 19 of the part 9, from above. The side surfaces 21 and 22 of the segments 19 and 20, which surfaces face towards each other, are inclined in respect of the axis, e.g. at an angle of about 15°. The width of the gaps formed between the side surfaces 21 and 22 is therefore adjustable by displacing the stator part 10 in the axial direction in relation to the stator part 9. By means of this adjustment of the width of the gap passages it is possible to adjust the amount of substance flowing through the homogenization stirrer, and thus the dwell time of the substance in the stirrer, whereby the stirrer can be adapted to the viscosity of the substance. The segments 19 and 20 of the two stator parts are provided with conical internal surfaces 23 and 24 respectively, which face towards the stator 5 and interact with this latter. By axially displacing the stator part 10, therefore, it is also possible to adjust the width of the gap between the rotor 5 and the internal surfaces 24 (while the gap between the rotor 5 and the internal surfaces 23 remains constant). However, even when the gap passages in the stator are adjusted to a minimum flow rate, the gap between rotor 5 and internal surfaces 24, constituting only a minor portion of the total rubbing gap between the rotor and the stator, will not be so narrow as to cause an excessive heating of the medium in the rubbing gap.

Figure 6:
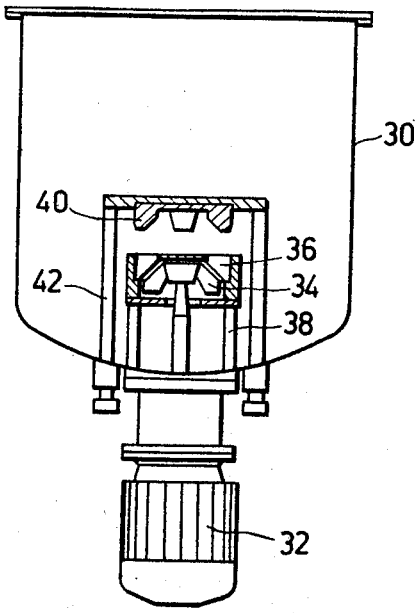
FIG. 6 shows a homogenization stirrer in an individual vessel.
Figure 7:
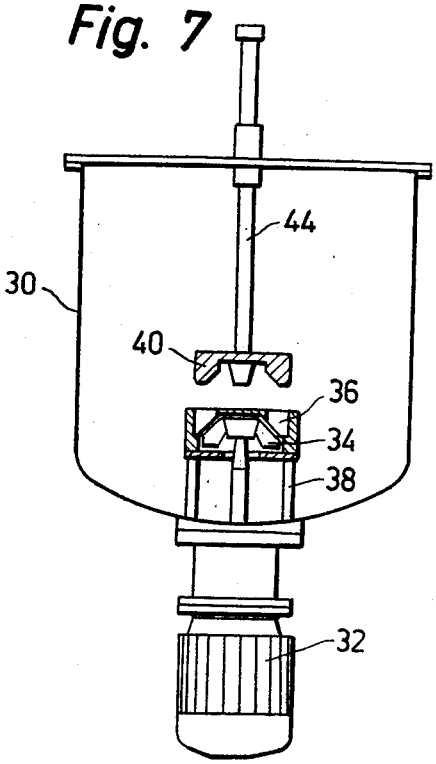
FIG. 7 shows the same as FIG. 6 but with the adjusting devices for the adjustable stator part arranged differently.

FIGS. 6 and 7 are schematic diagrams of two items of apparatus which, in each case in a vessel 30, only have a homogenization stirrer of the type described. A driving motor 32 for the rotor 34 of the homogenization stirrer is in this case affixed to the lower side of the vessel 30, the rotor shaft passing through the floor of the vessel. The fixed stator part 36 rests on the floor of the vessel by supports 38. As shown in FIG. 6, the stator part 40, axially adjustable in relation to the stator part 36 and to the rotor 34, is borne by supports 42 which pass through the floor of the vessel and can be moved upwards and downwards from outside this latter (e.g. by means of a threaded nut, as shown in FIG. 1). In FIG. 7 that adjustable stator part 40 is secured by a central support 44 which passes through the cover of the vessel 30 and is adjustable from above.

In FIGS. 6 and 7 the adjustable stator part 40 is shown a considerable distance above the fixed stator part 36, merely in order to make the diagram clearer; in reality the two parts always engage each other by their segments when the apparatus is in operation. (They are constructed similarly to stator parts 9 and 10 in FIGS. 1 – 5).

What we claim is:

1. A homogenization stirrer for use with materials having differing ranges of viscoscity and homogeneity, the stirrer comprising; a rotor, a stator spaced from said rotor and defining a rubbing gap, means for rotating said rotor relative to said stator and including rotor blades for sucking a medium axially from one side and thrusting it axially towards the side opposite said one side, said stator comprising two interengaging parts both located on one and the same side of said rotor and defining a plurality of passage gaps between said two parts, said passage gaps forming a plurality of passages through which said medium is passed out of said stator for homogenizing the same, and means for axially adjusting spacing of one of said two parts in relation to the other part of said two parts for adjusting the width of said passage gaps in said stator and thus back pressure and flow rate to determine dwell time of the medium in the rubbing gap.

2. A stirrer according to claim 1, wherein said last mentioned means comprise means for steplessly adjusting spacing between said two parts relative to one another and means for holding said two parts in any adjusted relative position.

* * * * *